US010248037B2

(12) United States Patent
Hiraide

(10) Patent No.: US 10,248,037 B2
(45) Date of Patent: Apr. 2, 2019

(54) DEVELOPER, DEVELOPER STORAGE BODY, DEVELOPING DEVICE AND IMAGE FORMING APPARATUS

(71) Applicant: Oki Data Corporation, Tokyo (JP)

(72) Inventor: Manami Hiraide, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 15/654,690

(22) Filed: Jul. 19, 2017

(65) Prior Publication Data

US 2018/0031989 A1 Feb. 1, 2018

(30) Foreign Application Priority Data

Jul. 27, 2016 (JP) ..... 2016-146872

(51) Int. Cl.

| | |
|---|---|
| ***G03G 9/09*** | (2006.01) |
| ***G03G 9/087*** | (2006.01) |
| ***G03G 15/08*** | (2006.01) |
| ***G03G 9/08*** | (2006.01) |
| *G03G 21/18* | (2006.01) |

(52) U.S. Cl.

CPC ..... *G03G 9/0926* (2013.01); *G03G 9/0812* (2013.01); *G03G 9/0817* (2013.01); *G03G 9/0819* (2013.01); *G03G 9/08755* (2013.01); *G03G 9/09* (2013.01); *G03G 9/0902* (2013.01); *G03G 15/0858* (2013.01); *G03G 9/0821* (2013.01); *G03G 21/1807* (2013.01); *G03G 21/1814* (2013.01); *G03G 2215/0888* (2013.01)

(58) Field of Classification Search

CPC .. G03G 9/0821; G03G 9/0819; G03G 9/0926; G03G 9/0902

See application file for complete search history.

(56) References Cited

U.S. PATENT DOCUMENTS

| | | | | |
|---|---|---|---|---|
| 6,168,892 | B1 * | 1/2001 | Ohara | B41M 1/18 106/420 |
| 9,389,529 | B2 * | 7/2016 | Hirai | G03G 9/0924 |
| 2012/0237868 | A1 | 9/2012 | Yamada et al. | |
| 2014/0045113 | A1 | 2/2014 | Takahashi et al. | |
| 2014/0234765 | A1 | 8/2014 | Hirai et al. | |
| 2015/0111140 | A1 | 4/2015 | Noguchi et al. | |

FOREIGN PATENT DOCUMENTS

JP 2009-143092 A 7/2009

OTHER PUBLICATIONS

RCA Electro-Optics Handbook, Technical Series EOH-11, RCA Corporation, PA (1974), pp. 13-14.*

* cited by examiner

*Primary Examiner* — Janis L Dote

(74) *Attorney, Agent, or Firm* — Rabin & Berdo, P.C.

(57) ABSTRACT

A developer including developer particles. Each developer particle includes a binder resin, a brilliant pigment whose principal component is aluminum, a yellow pigment, a magenta pigment, a reddish-orange fluorescent dye, and a yellow fluorescent dye. When an average particle diameter of the brilliant pigments included in the developer particles is expressed as D (μm), a number proportion of the developer particles having particle diameters in a range from 4 μm to 1.2×D μm in the whole developer particles is less than or equal to 4%.

9 Claims, 5 Drawing Sheets

| | EXAMPLE1 | EXAMPLE2 | COMPARISON EXAMPLE1 |
|---|---|---|---|
| NUMBER AVERAGE PARTICLE DIAMETER(μm) | 8.169 | 8.501 | 7.521 |
| NUMBER PROPORTION OF TONER OF 4-6 μm (%) | 4.0 | 2.2 | 10.6 |
| MAXIMUM CHANGING AMOUNT OF b* AFTER PRINTING | -4.11 | -1.84 | -11.59 |

DEVELOPER, DEVELOPER STORAGE BODY, DEVELOPING DEVICE AND IMAGE FORMING APPARATUS

BACKGROUND OF THE INVENTION

The present invention relates to a developer, a developer storage body, a developing device and an image forming apparatus used for electrophotographic image formation.

Generally, techniques to form an image using toners (developers) of yellow, magenta, cyan and black by electrophotography are widely used. Recently, there are requirements to form an image using a brilliant toner having brilliance, such as a gold toner or a silver toner. See, for example, Japanese Patent Application Publication No. 2009-143092 (abstract).

A brilliant toner (for example, a gold toner) includes a plurality of kinds of pigments such as a brilliant pigment. The general brilliant pigment has a diameter of 5-10 μm, and is not easily contained in a toner particle. As a proportion of toner particles containing no brilliant toner increases, a yellow tint of a toner image becomes low. Therefore, for example, a tint of a toner image printed in a final stage of a continuous printing is different from that printed in an initial stage of the continuous printing.

SUMMARY OF THE INVENTION

An object of an embodiment of the present invention is to provide a developer, a developer storage body, a developing device and an image forming apparatus capable of suppressing a change in tint of a developer image.

According to an aspect of the present invention, there is provided a developer including developer particles. Each developer particle includes a binder resin, a brilliant pigment whose principal component is aluminum, a yellow pigment, a magenta pigment, a reddish-orange fluorescent dye, and a yellow fluorescent dye. When an average particle diameter of the brilliant pigments included in the developer particles is expressed as D (μm), a number proportion of the developer particles having particle diameters in a range from 4 μm to 1.2×D μm in the whole developer particles is less than or equal to 4%.

With such a configuration, a proportion of the developer particles containing no brilliant pigment is reduced, and therefore a change in tint of a developer image can be suppressed.

DETAILED DESCRIPTION OF THE PREFERRED EMBODIMENT

<Configuration of Image Forming Apparatus>

Figure 1:
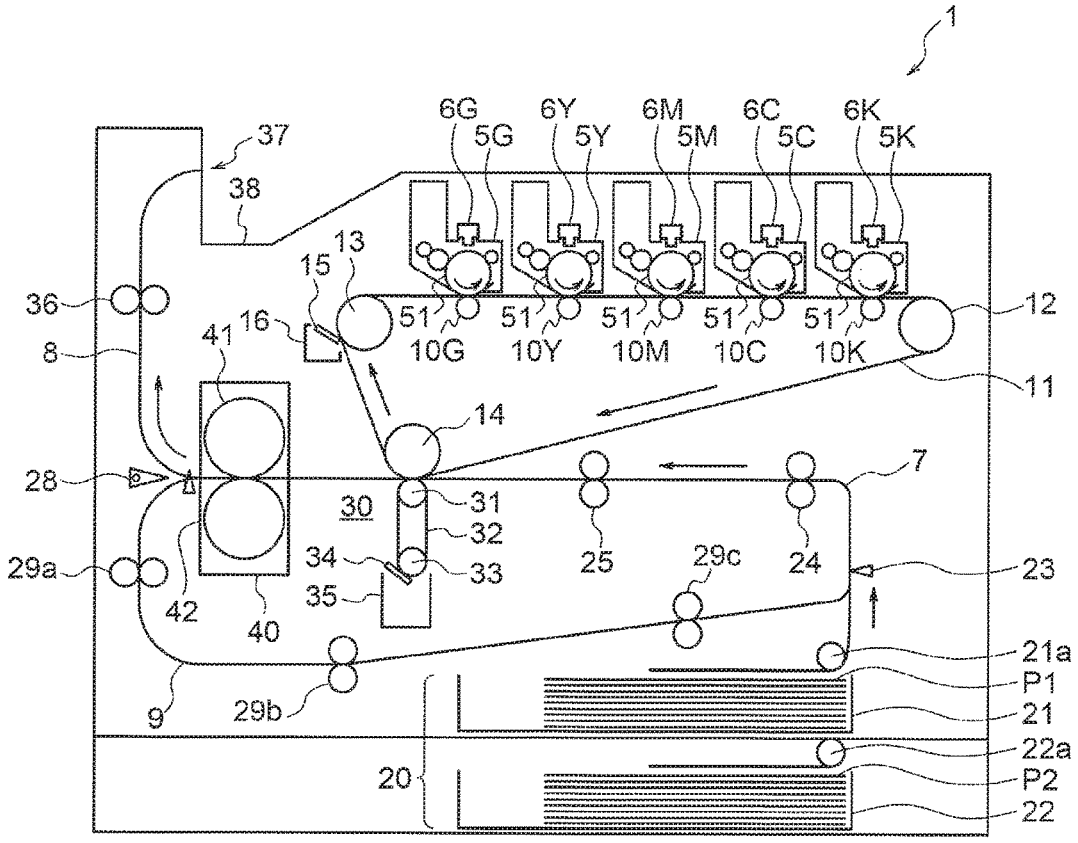
FIG. 1 is a schematic view showing a configuration of an image forming apparatus according to an embodiment of the present invention.

FIG. 1 is a schematic view showing a configuration of an image forming apparatus according to an embodiment of the present invention. The image forming apparatus 1 is, for example, a color printer. The image forming apparatus 1 is configured to print a toner image (i.e., a developer image) on a recording medium using electrophotography based on print data transmitted from a host computer (i.e., a host device). In a particular example, the image forming apparatus 1 has a duplex printing function, and is configured to perform image formation (i.e., printing) on a recording medium selected from two kinds of recording media. In this regard, the image forming apparatus 1 may also be configured not to have a duplex printing function, and may also be configured to perform image formation on a single kind of recording medium.

The image forming apparatus 1 includes a feeding mechanism 20 as a medium feeder, process units 5G, 5Y, 5M, 5C and 5K as image forming units, LED (Light Emitting Diode) heads 6G, 6Y, 6M, 6C and 6K as exposure devices, an intermediate transfer belt 11 as an intermediate transfer body, primary transfer rollers 10G, 10Y, 10M, 10C and 10K as primary transfer portions, a secondary transfer portion 30 and a fixing device 40.

The feeding mechanism 20 includes a medium cassette 21 as a medium storage portion that stores a stack of recording media P1, and a medium cassette 22 as a medium storage portion that stores a stack of recording media P2. Both of the medium cassettes 21 and 22 are detachably mounted to a main body of the image forming apparatus 1. In a particular example, the medium cassette 21 is disposed above the medium cassette 22.

The medium cassette 21 includes a feed roller 21*a* configured to feed the recording medium P1 one by one into a transport path 7. The medium cassette 22 includes a feed roller 22*a* configured to feed the recording medium P2 one by one into the transport path 7. When one of the medium cassettes 21 and 22 is selected, the feed roller of the selected medium cassette rotates to feed the recording medium into the transport path 7. In this regard, the recording medium P1 or the recording medium P2 fed into the transport path 7 will be referred to as "the recording medium P".

A writing sensor 23, a pair of registration rollers 24 and a pair of transport rollers 25 are arranged along the transport path 7. The writing sensor 23 detects a leading edge of the recording medium P1 fed into the transport path 7 from the feeding mechanism. 20. The registration rollers 24 and the transport rollers 25 rotate to transport the recording medium P1 toward the secondary transfer portion 30.

The process units 5G, 5Y, 5M, 5C and 5K form a toner image using a brilliant toner (G) as a brilliant developer, a yellow toner (Y), a magenta toner (M), a cyan toner (C) and a black toner (K). The process units 5G, 5Y, 5M, 5C and 5K are arranged along a moving direction of the intermediate transfer belt 11, i.e., from left to right in FIG. 1.

The LED heads 6G, 6Y, 6M, 6C and 6K are disposed above and facing respective photosensitive drums 51 (described later) of the process units 5G, 5Y, 5M, 5C and 5K. The LED heads 6G, 6Y, 6M, 6C and 6K emit light to expose surfaces of the photosensitive drums 51 based on image data of respective colors and form latent images (i.e., electrostatic latent images).

The process units 5G, 5Y, 5M, 5C and 5K have the same configuration except for toners, and therefore the process units 5G, 5Y, 5M, 5C and 5K will be collectively referred to as "the process units 5". Similarly, the LED heads 6G, 6Y, 6M, 6C and 6K will be collectively referred to as "the LED heads 6".

Figure 2:
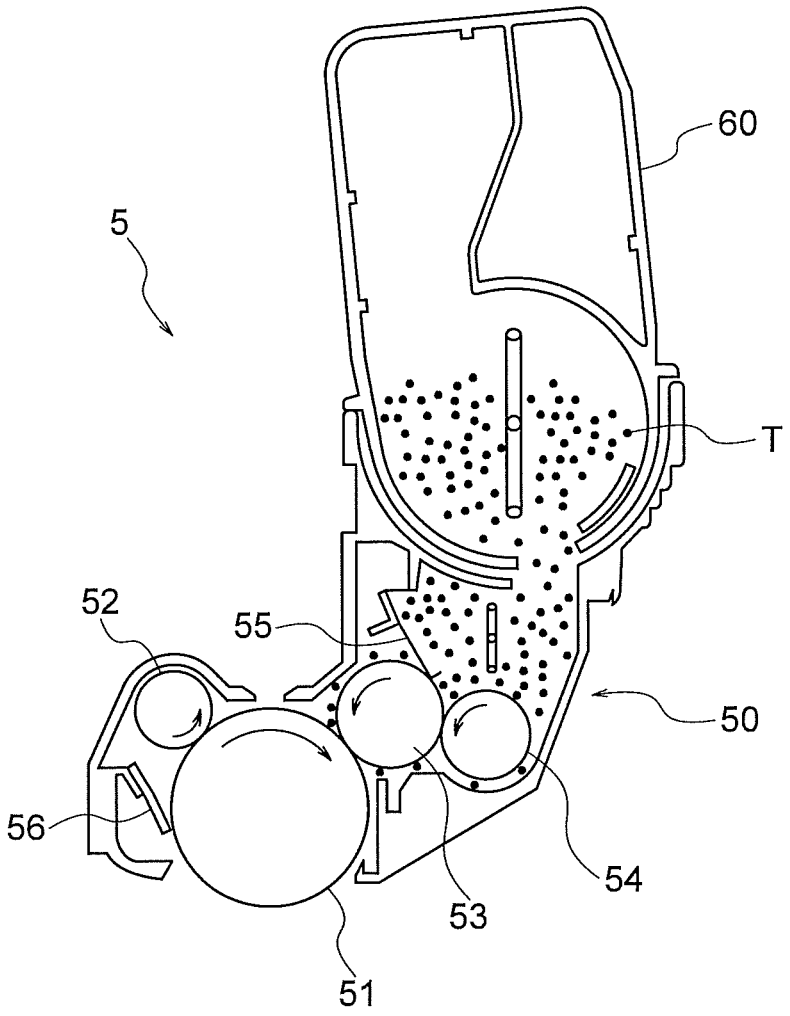
FIG. 2 is a sectional view showing a configuration of a process unit according to the embodiment of the present invention.

FIG. 2 is a sectional view showing a configuration of the process unit 5. The process unit 5 includes a photosensitive drum 51 as an image bearing body, a charging roller 52 as a charging member, a developing roller 53 as a developer bearing body, a supply roller 54 as a supply member, a developing blade 55 as a developer regulation member, a cleaning blade 56 as a cleaning member, and a developer cartridge 60 as a developer storage body.

Among components of the process unit 5, a section including the developing roller 53, the supply roller 54, the developing blade 55 and the developer cartridge 60 (i.e., a section contributing to development of a latent image) constitutes a developing device 50.

The photosensitive drum 51 includes a cylindrical conductive support formed of aluminum, and a photosensitive layer (i.e., a charge generating layer and a charge transport layer) laminated on a surface of the conductive support. The photosensitive drum 51 rotates counterclockwise in FIG. 1 (i.e., clockwise in FIG. 2). The photosensitive layer on the surface of the photosensitive drum 51 is exposed with light emitted by the LED head 6 (FIG. 1), and an electrostatic latent image is formed.

The charging roller 52 includes, for example, a metal shaft and a semiconductive epichlorohydrin rubber layer formed on the metal shaft. The charging roller 52 is disposed so as to contact the surface of the photosensitive drum 51. The charging roller 52 rotates following a rotation of the photosensitive drum 51. The charging roller 52 is applied with a charging voltage, and uniformly charges the surface of the photosensitive drum 51.

The developing roller 53 includes, for example, a metal shaft and a semiconductive urethane rubber layer formed on the metal shaft. The developing roller 53 is disposed so as to contact the surface of the photosensitive drum 51. The developing roller 53 rotates in an opposite direction to a rotating direction of the photosensitive drum 51. In other words, the surfaces of the developing roller 53 and the photosensitive drum 51 in contact with each other move in the same direction. The developing roller 53 is applied with a developing voltage, and develops the electrostatic latent image on the surface of the photosensitive drum 51 with toner.

The supply roller 54 includes, for example, a metal shaft and a semiconductive foamed silicon sponge layer formed on the metal shaft. The supply roller 54 is disposed so as to contact the developing roller 53, or disposed so as to face the developing roller 53 with a gap formed therebetween. The supply roller 54 rotates in the same direction as the rotating direction of the developing roller 53. The supply roller 54 is applied with a supply voltage, and supplies the toner to the developing roller 53.

The developing blade 55 is a blade formed of, for example, stainless steel. The developing blade 55 is disposed so as contact the surface of the developing roller 53. The developing blade 55 regulates a thickness of a toner layer on the surface of the developing roller 53.

The cleaning blade 56 is a blade formed of, for example, urethane rubber. The cleaning blade 56 is disposed so as to contact the surface of the photosensitive drum 51. The cleaning blade 56 removes a residual toner that remains on the surface of the photosensitive drum 51.

The developer cartridge (i.e., a developer storage body) 60 is detachably mounted to an upper part of the process unit 5. The developer cartridge 60 stores a toner (i.e., a developer) therein, and supplies the toner to the developing roller 53 and the supply roller 54. The developer cartridge 60 of the process unit 5G (FIG. 1) stores a brilliant toner (for example, a gold toner).

Figure 3:
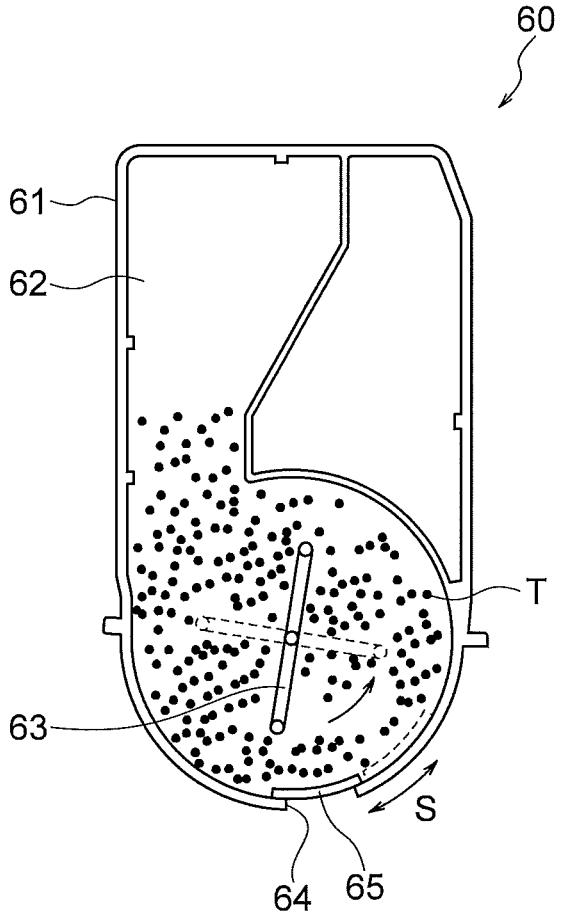
FIG. 3 is a sectional view showing a configuration of a developer cartridge according to the embodiment of the present invention; p

FIG. 3 is a sectional view showing an internal configuration of the developer cartridge 60. As shown in FIG. 3, the developer cartridge 60 includes a container 61 and a developer storage portion 62 provided in the container 61. The developer storage portion 62 stores a toner (referred to as mark T) as a developer. An agitation bar 63 is rotatably provided in the developer storage portion 62, and extends in a longitudinal direction of the developer storage portion 62. An outlet opening 64 is formed on a bottom of the developer cartridge 60 for ejecting the toner from the developer storage portion 62. A shutter 65 is provided at a bottom part of the developer storage portion 62. The shutter 65 is provided for opening and closing the outlet opening 64. The shutter 65 is slidable in a direction shown by an arrow S in FIG. 3.

Referring back to FIG. 1, the primary transfer rollers 10G, 10Y, 10M, 10C and 10K as primary transfer portions are disposed below and facing respective photosensitive drums 51 of the process units 5G, 5Y, 5M, 5C and 5K. Each of the primary transfer rollers 10G, 10Y, 10M, 10C and 10K includes, for example, a metal shaft and a foamed rubber layer. Each of the primary transfer rollers 10G, 10Y, 10M, 10C and 10K is applied with a primary transfer voltage.

The intermediate transfer belt 11 is disposed so as to pass through between respective photosensitive drums 51 of the process units 5G, 5Y, 5M, 5C and 5K and the primary transfer rollers 10G, 10Y, 10M, 10C and 10K. The toner images on the photosensitive drums 51 of the process units 5G, 5Y, 5M, 5C and 5K are transferred to the intermediate transfer belt 11 by the primary transfer voltages applied to the primary transfer rollers 10G, 10Y, 10M, 10C and 10K.

The intermediate transfer belt 11 is an endless belt formed of semiconductive plastic or the like. The intermediate transfer belt 11 is wound around a driving roller 12, a tension roller 13 and a secondary transfer backup roller 14. The driving roller 12, the tension roller 13 and the secondary transfer backup roller 14 are disposed on an inner circumference side of the intermediate transfer belt 11. The driving roller 12 rotates clockwise in FIG. 1 to move the intermediate transfer belt 11 in a direction shown by an arrow. The tension roller 13 applies a certain tension to the intermediate transfer belt 11.

A cleaning blade 15 and a cleaner container 16 are disposed on an outer circumference side of the intermediate transfer belt 11. The cleaning blade 15 is configured to scrape off the toner from an outer circumferential surface of the intermediate transfer belt 11. The cleaner container 16 is configured to store the toner scraped off by the cleaning blade 15. In this regard, the cleaning blade 15 may also be configured to be shiftable in a direction toward and away from the intermediate transfer belt 11.

The secondary transfer portion 30 includes a secondary transfer roller 31 disposed facing the secondary transfer backup roller 14, a driving roller 33 disposed at a certain distance from the secondary transfer roller 31, and a secondary transfer belt 32 wound around the secondary transfer roller 31 and the driving roller 33. The secondary transfer belt 32 is an endless belt formed of semiconductive plastic or the like, and rotates by a rotation of the driving roller 33.

Between the secondary transfer roller 31 and the secondary transfer backup roller 14, a nip (i.e., a secondary transfer nip) is formed by the intermediate transfer belt 11 and the secondary transfer belt 32. The toner image primarily transferred to the intermediate transfer belt 11 is secondarily transferred to the recording medium p at the secondary transfer nip.

Further, a cleaning blade 34 and a cleaner container 35 are disposed on an outer circumference side of the secondary transfer belt 32. The cleaning blade 34 is configured to scrape off the toner from an outer circumferential surface of the secondary transfer belt 32. The cleaner container 35 is configured to store the toner scraped off by the cleaning blade 34.

The fixing device 40 is disposed downstream of the secondary transfer portion 30 along the transport path 7. The fixing device 40 includes a heat roller 41 and the pressure roller 42.

The heat roller 41 includes, for example, a metal core having a hollow cylindrical shape, a heat-resistant elastic layer of silicone rubber covering the metal core, and a PFA (tetrafluoro-ethylene perfluoroalkyl vinyl ether copolymer) tube covering the elastic layer. A heater such as a halogen lamp is disposed inside the metal core.

The pressure roller 42 includes, for example, a metal core of aluminum, a heat-resistant elastic layer of silicone rubber covering the metal core, and a PFA tube covering the elastic layer. The pressure roller 42 is pressed against the heat roller 41 so as to form a nip (i.e., a fixing nip) between the heat roller 41 and the pressure roller 42.

A switching guide 28 is disposed downstream (i.e., left in FIG. 1) of the fixing device 40 along the transport path 7. The switching guide 28 is configured to switch a transport direction of the recording medium P. To be more specific, the switching guide 28 introduces the recording medium p (ejected from the fixing device 40) into selected one of an ejection transport path 8 and a return path 9.

A pair of ejection rollers 36 are disposed along the ejection transport path 8. The ejection rollers 36 transport the recording medium p (ejected from the fixing device 40) and eject the recording medium p outside the image forming apparatus 1 through an ejection opening 37. A stacker portion 38 is provided on a top cover of the image forming apparatus 1. The recording medium p ejected through the ejection opening 37 is placed on the stacker portion 38.

The return path 9 extends from a position where the switching guide 28 is disposed to an entry portion (i.e., a portion upstream of the writing sensor 23) of the above described transport path 7. Transport rollers 29*a*, 29*b* and 29*c* are arranged along the return path 9. In a duplex printing mode, it is necessary to reverse the recording medium P. For this reason, the recording medium p ejected from the fixing device 40 is once introduced into the ejection transport path 8. Then, the ejection rollers 36 reverse the rotating directions, and transport the recording medium p into the return path 9.

<Operation of Image Forming Apparatus>

Next, an image forming operation (i.e., a printing operation) of the image forming apparatus 1 will be described. When the image forming operation starts, respective rollers of the process units 5G, 5Y, 5M, 5C and 5K, the driving roller 12, the driving roller 33 and the heat roller 41 start rotating. Further, in each of the process units 5G, 5Y, 5M, 5C and 5K, bias voltages (i.e., the charging voltage, the developing voltage and the supply voltage) are applied to the charging roller 52, the developing roller 53 and the supply roller 54.

The charging roller 52 uniformly charges the surface of the photosensitive drum 51. The LED head 6 emits light to expose the surface of the photosensitive drum 51 based on an image data signal. A potential of the exposed part of the surface of the photosensitive drum 51 is attenuated, and an electrostatic latent image is formed on the surface of the photosensitive drum 51.

The toner stored in the developer cartridge 60 is supplied to the developing roller 53 and the supply roller 54, and adheres to the surface of the developing roller 53 due to a potential difference between the developing roller 53 and the supply roller 54. The developing blade 55 regulates a thickness of a layer of the toner on the surface of the developing roller 53, and a toner layer with a uniform thickness is formed on the developing roller 53.

The toner on the developing roller 53 adheres to the electrostatic latent image formed on the surface of the photosensitive drum 51 due to a potential difference between the photosensitive drum 51 and the developing roller 53. The electrostatic latent image is developed with the toner, and a toner image (i.e., a developer image) is formed on the surface of the photosensitive drum 51. A process from the start of rotation of the photosensitive drum 51 until the formation of the toner image on the surface of the photosensitive drum 51 is referred to as a developing process.

The toner images on the surfaces of the photosensitive drums 51 of the process units 5G, 5Y, 5M, 5C and 5K are primarily transferred to the intermediate transfer belt 11 by the primary transfer voltages applied to the primary transfer rollers 10G, 10Y, 10M, 10C and 10K.

As the intermediate transfer belt 11 is moved by the driving roller 12, the toner image on the intermediate transfer belt 11 proceeds toward the secondary transfer belt 32.

The recording medium P1 (or the recording medium P2) stored in the medium cassette selected from the medium cassettes 21 and 22 of the feeding mechanism 20 is fed into the transport path 7 by the rotation of the feed roller 21*a* (or the feed roller 22*a*).

The recording medium p (P1 or P2) fed into the transport path 7 is transported by the registration rollers 24 and the transport rollers 25 in a direction shown by an arrow, and reaches the secondary transfer nip between the secondary transfer roller 31 and the secondary transfer backup roller 14. The secondary transfer belt 32 has already started rotation by the rotation of the driving roller 33. In this regard, the above described developing process in each of the process units 5G, 5Y, 5M, 5C and 5K is started at a predetermined timing before the recording medium p reaches the secondary transfer nip.

The toner image on the intermediate transfer belt 11 and the recording medium p reach the secondary transfer nip (between the secondary transfer roller 31 and the secondary transfer backup rollers 14) at the same time. The secondary transfer voltage is applied to the secondary transfer roller 31, and the toner image is secondarily transferred from the surface of the intermediate transfer belt 11 to the recording medium P.

The recording medium p to which the toner image is transferred is transported to the fixing device 40 disposed downstream of the secondary transfer portions 30. The heat roller 41 of the fixing device 40 is preliminarily heated to a predetermined fixing temperature by, for example, a temperature control circuit. As the recording medium P proceeds into between the rotating heat roller 41 and the pressure roller 42 (i.e., the fixing nip), the toner image on the surface of the recording medium p is applied with heat and pressure. With the application of heat and pressure, the toner image is molten, and is fixed to the recording medium P.

The recording medium p ejected from the fixing device 40 is introduced into the ejection transport path 8 by the switching guide 28. The recording medium p is transported by the ejection rollers 36 along the ejection transport path 8, is ejected through the ejection opening 37, and is placed on the stacker portion 38.

In the duplex printing mode, the recording medium p with the toner image fixed to a first side (i.e., a front surface) thereof is once transported to the ejection transport path 8. Then, the rotating directions of the ejection rollers 36 are reversed, and the recording medium p is transported into the return path 9. The recording medium p is transported by the transport rollers 29*a*, 29*b* and 29*c* along the return path 9 to the entry portion of the transport path 7, and image formation on a second side (i.e., a back surface) is performed.

<Toner>

Next, a brilliant toner as a brilliant developer of the embodiment will be described. The brilliant toner (also referred to as a luminescent toner) of the embodiment includes a binder resin and pigments. The pigments include a brilliant pigment (also referred to as a luminescent pigment) whose principal component (i.e., main component) is aluminum, a yellow pigment (in a particular example, an organic pigment), a magenta pigment (in a particular example, an organic pigment), a reddish-orange fluorescent dye, and a yellow fluorescent dye. An average particle diameter of the brilliant pigments is expressed as D (μm). In the toner particles, a number proportion of the toner particles whose particle diameters are in a range from 4 μm to 1.2×D μm is less than or equal to 4%.

As a proportion of the toner particles containing no brilliant pigment (in the whole toner particles forming a toner image) increases, a tint of the toner image may easily change as described later. For this reason, in this embodiment, the proportion of the toner particles containing no brilliant pigment is reduced, in order to suppress a change in tint.

That is, the brilliant pigments whose average particle diameter is D (for example, 5 μm) are not easily contained in the toner particle whose particle diameter is less than 1.2×D μm. Therefore, in this embodiment, the proportion of the toner particles whose particle diameters are less than 1.2×D μm (for example, 6 μm) is reduced to a certain value or less.

In this regard, a proportion (referred to as a number proportion) of the number of the toner particles whose particle diameters are in a predetermined range in relation to the total number of the whole toner particles is controlled by measuring a particle diameter distribution of the toner particles.

In this regard, when the particle diameter of the toner particle is too small, the number of the particle diameter cannot be correctly measured. For this reason, in this embodiment, the number proportion of the toner particles having particle diameters in a range from 4 μm to 1.2×D μm is controlled, where D represents the average particle diameter of the brilliant pigments. Further, the term "whole toner particles" (i.e., whole developer particles) is used to mean the toner particles whose particle diameters are measurable (i.e., larger than or equal to 4 μm) using the particle diameter distribution measurement.

The brilliant toner of this embodiment is, for example, a gold toner, and is formed using a dissolution suspension method. That is, the brilliant toner of this embodiment include toner mother particles. The toner mother particles are formed by mixing a water phase and an oil phase, and granulating the resultant mixture. The water phase is obtained by solving and dispersing the binder resin and the pigments in an organic solvent. The oil phase is obtained by dispersing inorganic fine particles (i.e., a dispersant) in an aqueous medium. The toner particles are formed by adding external additives to the toner mother particles.

First, manufacturing methods of brilliant toners of Examples 1 through 6 and Comparison Example 1 will be described.

Example 1

First, a pigment dispersion liquid is prepared. 1.60 weight parts of a first dispersant "SOLSPERS 39000" (manufactured by Japan Lubrizol Corporation) and 0.40 weight parts of a second dispersant "SOLSPERS 22000" (manufactured by Japan Lubrizol Corporation) are dissolved in 86.57 weight parts of a dispersion medium (ethyl acetate) as an organic solvent. The resultant medium is added with 10.00 weight parts of a yellow pigment "C. I. Pigment Yellow 180" and 1.43 weight parts of a magenta pigment "C. I. Pigment Red 122", and is subjected to dispersion process.

The dispersion process is performed using a batch type ready mill dispersion machine (manufactured by PRIMIX Corporation). The dispersion machine has a cylindrical container with a rotation plate. The medium, the pigments and zirconia beads are put in the cylindrical container, and are agitated. A bead diameter is 0.3 mm, and a bead filling rate is 55%. A pre-dispersion processing is performed at a dispersion speed (i.e., a rotation speed of the rotation plate) of 1.2 m/s for 5 minutes, and a main dispersion processing is performed at the dispersion speed of 3.8 m/s for 10 minutes. As a result, a pigment dispersion liquid where the pigments are dispersed is obtained.

Next, an aqueous phase is prepared. 2.79 weight parts of trisodium phosphate dodecahydrate is mixed with 82.16 weight parts of pure water, and is dissolved at a temperature of 60° C. Then, a dilute nitric acid is added for pH adjustment. The resultant liquid mixture is added with a calcium chloride solution obtained by dissolving 1.35 weight parts of calcium chloride in 13.69 weight parts of pure water. Then, the resultant liquid mixture is stirred using a "neo-mixer" (manufactured by PRIMIX Corporation) for 34 minutes at a rotation speed of 3600 rpm while keeping a temperature of 60° C.

As a result, an aqueous solution including a suspension stabilizer (i.e., a dispersant) is obtained.

Next, an oil medium (i.e., an oil phase) is prepared. 2.83 weight parts of the above described pigment dispersion liquid and 2.90 weight parts of an aluminum pigment (i.e., the brilliant pigment) whose average particle diameter is 5 μm are added to 82.86 weight parts of an organic solvent (ethyl acetate). The aluminum pigment is formed of aluminum pieces whose average particle diameter (i.e., a volume average particles diameter) is 5 μm. The resultant liquid mixture is heated to a temperature of 50° C., and is stirred. The resultant liquid mixture is added with 9.22 weight parts of polyester resin (i.e., a binder resin), 0.71 weight parts of a yellow fluorescent dye "FM-35N_Yellow" (manufactured by SINLOICHI Company Limited), and 0.24 weight parts of a reddish-orange fluorescent dye "FM-34N Orange" (manufactured by SINLOICHI Company Limited). The resultant liquid mixture is stirred until solid contents are dissolved. The resultant mixture is added with 1.10 weight parts of a releasing agent (i.e., paraffin wax) and 0.15 weight parts of a charge control agent "Bontron E-84" (manufactured by Orient Chemical Industries Company Limited). As a result, an oil phase in which the pigments are dispersed is obtained.

Then, the aqueous phase and the oil phase are mixed so that a weight ratio of the aqueous phase and the oil phase is 3:1. The aqueous phase and the oil phase are mixed for 5 minutes at a rotation speed of 2000 rpm, and the resultant mixed phase is suspended and granulated, with the result that particles are formed. Then, ethyl acetate is removed by a vacuum distillation, and a slurry is obtained.

Then, the slurry is added with nitric acid to reduce a PH value to be lower than or equal to 1.5, and is stirred. Then, tricalcium phosphate (i.e., a suspension stabilizer) is dispersed in the slurry, and the slurry is dehydrated. Particles obtained after dehydration is re-dispersed in pure water, and the pure water is stirred so as to perform water cleaning. Then, the resultant particles are dehydrated and dried. As a result, toner mother particles are formed.

Next, classification of the toner mother particles is performed. The classification is performed using an "Elbow-Jet Air Classifier" (manufactured by Nittetsu Mining Company Limited).

Figure 4:
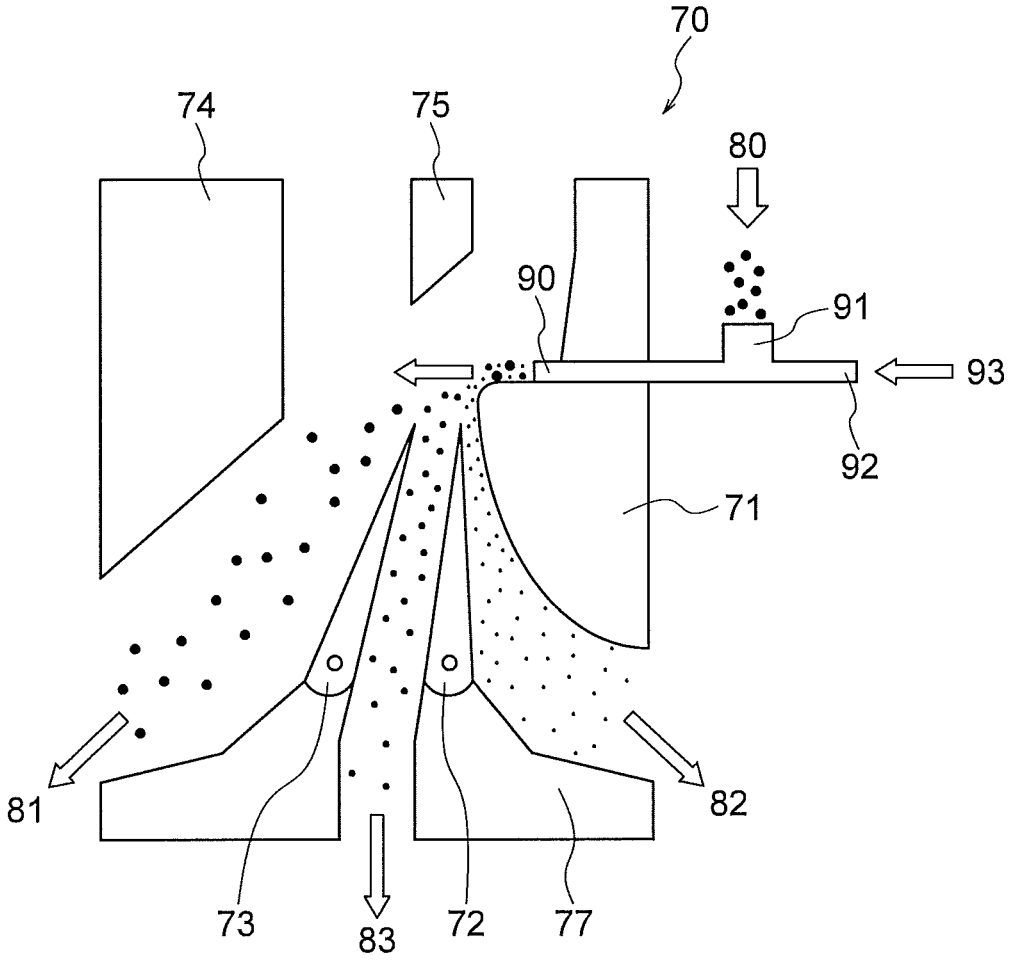
FIG. 4 is a schematic view for illustrating a principle of a classifier.

A configuration of the classifier is known. Here, a basic principle of the classifier is briefly described. FIG. 4 is a schematic view showing a basic principle of the classifier. The classifier 70 shown in FIG. 4 includes a Coanda block 71, an F (fine) edge 72, an M (medium) edge 73, G block 74, an air introduction edge 75 and an ejector (i.e., a supply nozzle) 90. The F edge 72 and the M edge 73 are also referred to as classification edges.

A material powder 80 (i.e., a classification object) is put into the ejector 90 through a material inlet 91 of the ejector 90, and is injected into the classifier 70 together with a compressed air 93 from an air inlet 92. In the classifier 70, particles of the material powder 80 is classified by an inertial force and a Coanda effect. Larger particles (i.e., a coarse powder) 81 fly further due to an inertial force, and smaller particles (i.e., a fine powder) 82 flow along the Coanda block 71 by the Coanda effect. Particles (i.e., a middle powder) 83 of a medium size pass through between the F edge 72 and the M edge 73, and are collected.

In this classifier 70, a distance from the Coanda block 71 to a tip of the F edge 72 is set to 15.0 mm, and a distance from the Coanda block 71 to a tip of the M edge 73 is set to 30.0 mm. The toner mother particles manufactured by the above-described method are supplied via the material inlet 91, and the middle-size powder 83 is collected. As a result, the classified toner mother particles are obtained.

A particle diameter distribution of the toner mother particles is measured using a particle diameter distribution measuring apparatus "Multisizer 3" (manufactured by Beckman Coulter Incorporated). Here, a number average particle diameter of the toner mother particles is 8.169 μm. A number proportion of the toner mother particles having particle diameters in a range of 4-6 μm (i.e., a range from 4 μm to 6 μm) in the whole toner mother particles measured based on the particle diameter distribution (i.e., a number-diameter distribution) is 4.0%.

100 weight parts of the toner mother particles in this way, 1.0 weight parts of a hydrophobic silica "RX50" (manufactured by Nippon Aerosil Company Limited) having an average primary particle diameter of 40 nm (i.e., an external additive), and 0.8 weight parts of a hydrophobic silica "RX200" (manufactured by Nippon Aerosil Company Limited) having an average primary particle diameter of 12 nm (i.e., an external additive) are mixed with each other using a HENSCHEL-MIXERS™ mechanical mixing machine having a capacity of 10 liters at a rotation speed of 5400 rpm for 10 minutes.

In this way, the external additives are added to the toner mother particles, and a toner of Example 1 is obtained. In this regard, diameters of the external additives are very small as compared with the diameter of the toner mother particle. Therefore, the diameter of the toner particle (i.e., the toner mother particle with the external additives) can be considered to be the same as the diameter of the toner mother particle.

Example 2

A toner of Example 2 is manufactured in the same manner as the toner of Example 1 except for a classification condition of the toner mother particles. The classification of the toner mother particles is performed by setting the distance from the Coanda block 71 to the tip of the F edge 72 to 17.0 mm, setting the distance from the Coanda block 71 to the tip of the M edge 73 to 22.0 mm, and collecting the middle-size powder 83.

The number average particle diameter of the toner mother particles of Example 2 is 8.501 μm. The number proportion of the toner particles having particle diameters in a range of 4-6 μm measured based on the particle diameter distribution (i.e., the number-diameter distribution) is 2.2%.

Comparison Example 1

A toner of Comparison Example 1 is manufactured in the same manner as the toner of Example 1 except for a classification condition of the toner mother particles. The classification of the toner mother particles is performed by setting the distance from the Coanda block 71 to the tip of the F edge 72 to 13.0 mm, setting the distance from the Coanda block 71 to the tip of the M edge 73 to 35.0 mm, and collecting the middle-size powder 83.

The number average particle diameter of the toner mother particles of Comparison Example 1 is 7.521 μm. The number proportion of the toner particles having particle diameters in a range of 4-6 μm measured based on the particle diameter distribution (i.e., the number-diameter distribution) is 10.6%.

<Printing Test>

Next, a printing test using the toners of Example 1, Example 2 and Comparison Example 1 will be described. The printing test is performed using a color printer "C941dn" (manufactured by Oki Data Corporation). Although the color printer "C941dn" has a configuration shown in FIG. 1 and includes five process units 5G, 5Y, 5M, 5C and 5K, the printing test is performed using only the process unit 5G.

A coated paper (i.e., a "color laser paper" having a basis weight of 186 g/m$^2$) of A4 size is used as the recording medium P. Further, the recording medium p (of A4 size) is transported in a long edge feed, i.e., transported so that a longitudinal direction of the recording medium p is parallel with an axial direction of the photosensitive drum 51.

A solid pattern is printed on the recording medium P. Then, a b* value is measured using a spectrum density meter "X-rite" (manufactured by X-rite Incorporated) at three positions, a left end position, a center position and a right end position at a leading end of the recording medium p in the transport direction. An average value of the b* values at three positions is defined as a b* value in an initial stage.

Next, a horizontal stripe pattern having a printing duty (i.e., a ratio of a printing area to a total printable area) of 1% is continuously printed on 1600 recording media p (i.e., 1600 sheets). The horizontal stripe pattern is in the form of a stripe (i.e., a band) extending in a direction perpendicular to the transport direction of the recording medium P. The above described solid pattern is printed every time when the horizontal strip patterns are printed on 200 recording media P, and a b* value of the solid pattern is measured at three positions, i.e., a left end position, a middle end position and a right end position at the leading end of the recording medium p in the transport direction. An average value of the b* values at three positions is defined as b* value in each stage.

<Test Result>

Figures 5, 6:
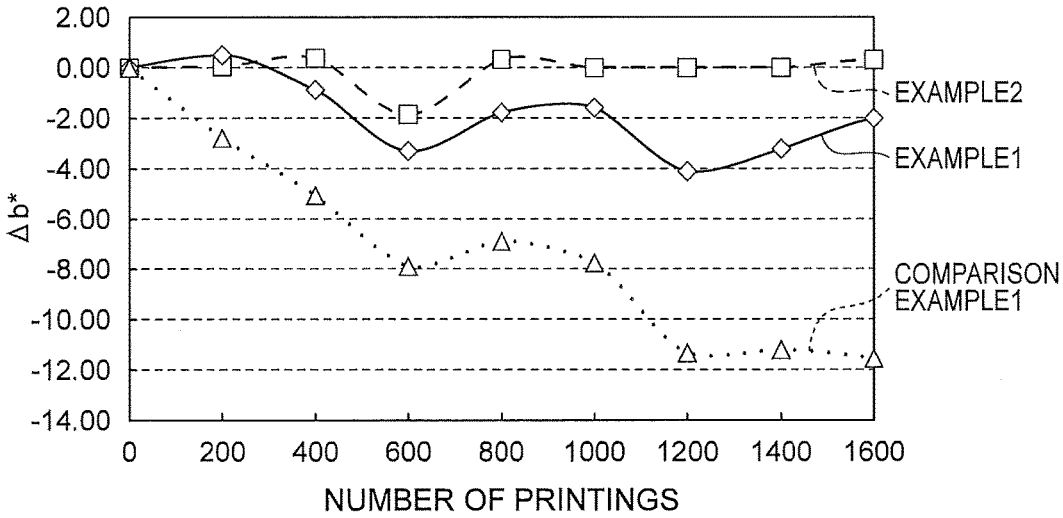
FIG. 5 is a graphic chart showing changes in b* values of toner images of Examples 1 and 2 and Comparison Example 1 with respect to a printing number, and p
FIG. 6 is a table showing maximum changing amounts of the b* values in Examples 1 and 2 and Comparison Example 1.

FIG. 5 shows a change in b* value with respect to a printing number of the recording medium P. A vertical axis (Δb*) represents a difference from the b* value in the initial stage (i.e., when the printing number is 0). A horizontal axis represents the printing number of the recording media p (from 0 to 1600). In FIG. 5, the measurement result of Example 1 is shown by a solid line, the measurement result of Example 2 is shown by a dashed line, and the measurement result of Comparison Example 1 is shown by a dotted line.

FIG. 6 shows the maximum changing amount of the b* value in each of Example 1, Example 2 and Comparison Example 1. FIG. 6 also shows the number average particle diameter (μm), and the number proportion of toner particles having particle diameters in a range of 4-6 μm (measured based on the particle diameter distribution) in each of Example 1, Example 2 and Comparison Example 1.

When the b* value is a positive value, and an absolute value of the b* value is larger, a yellow tint of an image becomes larger. When the b* value is a negative value, and an absolute value of the b* value is larger, a blue tint of an image becomes larger. When the b* value becomes lower than that in initial stage (i.e., when the printing number is 0), it indicates that the yellow tint of the image becomes lower.

From FIGS. 5 and 6, in Example 1 in which the number proportion of the toner particles having particle diameters in a range of 4-6 μm in the whole toner particles is 4.0%, the maximum changing amount of the b* value is −4.11. A change in tint from the initial stage is almost not observed with naked eyes. That is, a good result is obtained.

In Example 2 in which the number proportion of the toner particles having particle diameters in a range of 4-6 μm is 2.2%, the maximum changing amount of the b* value is −1.84. That is, a most satisfactory result is obtained.

In contrast, in comparison Example 1 in which the number proportion of the toner particles having particle diameters in a range of 4-6 μm is 10.6%, the maximum changing amount of the b* value is −11.59. A change in tint from the initial stage is observed with naked eyes.

The reason of this result is considered as follows. The brilliant toner includes a plurality of kinds of pigments (i.e., the brilliant pigments, the yellow pigments, the magenta pigments and the like), the brilliant pigments have the largest particle diameter and the average particle diameter thereof is 5 μm. The brilliant pigments having an average particle diameter of 5 μm are not easily contained in the toner particle whose diameter is 6 μm or less. Further, as a proportion of the small toner particles containing no brilliant pigment becomes large, a tint of a toner image may easily change.

In Comparison Example 1, the change in tint becomes large. This is considered to be because the number proportion of the toner particles having particle diameters in a range of 4-6 μm is as large as 10.6%. In contrast, in Examples 1 and 2, the change in tint is suppressed. This is considered to be because the number proportion of the toner particles having particle diameters in a range of 4-6 μm is less than or equal to 4% (preferably in a range from 2% to 4%, and more preferably in a range from 2.2% to 4%).

In this regard, the average particle diameter of the brilliant pigments is 5 μm in this embodiment. However, the average particle diameter of the brilliant pigments is not limited to 5 μm. When the average particle diameter of the brilliant pigments are expressed as D (μm), the brilliant pigments are not easily contained in the toner particle whose particle diameter is smaller than or equal to 1.2×D μm. Therefore, when the number proportion of the toner particles having particle diameters in a range of 4-6 μm is less than or equal to 4% (preferably in a range from 2% to 4%, and more preferably in a range from 2.2% to 4%), the change in tint can be suppressed.

The brilliant toner of this embodiment includes the reddish-orange fluorescent dye and the yellow fluorescent dye as described above. The reddish-orange fluorescent dye and the yellow fluorescent dye have function to enhance coloring property (i.e., to enhance brightness).

<Effects of Embodiment>

As described above, the toner (developer) of this embodiment includes toner particles each of which includes a binder resin, a brilliant pigment (whose principal component is aluminum), a magenta pigment, a reddish-orange fluorescent dye, and a yellow fluorescent dye. When the average particle diameter of the brilliant pigments is expressed as D (μm), the number proportion of the toner particles having particle diameters in a range from 4 μm to 1.2×D μm in the whole toner particles is less than or equal to 4%. With such a configuration, the number proportion of the tonner particles containing no brilliant pigment is reduced, and the change in tint of the toner image can be suppressed.

Further, when the number proportion of the toner particles having particle diameters in a range from 4 μm to 6 μm in the whole toner particles is less than or equal to 4% (more preferably in a range from 2% to 4%), the change in tint of the toner image can be effectively suppressed.

In the above described embodiment, the image forming apparatus of the intermediate transfer type configured to transfer a developer image using an intermediate transfer belt has been described. However, the present invention is also applicable to an image forming apparatus of a direct transfer type configured to directly transfer a toner image from a photosensitive drum to a recording medium.

While the preferred embodiments of the present invention have been illustrated in detail, it should be apparent that modifications and improvements may be made to the invention without departing from the spirit and scope of the invention as described in the following claims.

What is claimed is:

1. A developer comprising developer particles, each of the developer particles comprising:

a binder resin;

a brilliant pigment whose principal component is aluminum;

a yellow pigment;

a magenta pigment;

a reddish-orange fluorescent dye; and a yellow fluorescent dye, wherein when an average particle diameter of the brilliant pigments included in the developer particles is expressed as D (μm), a number proportion of the developer particles having particle diameters in a range from 4 μm to 1.2×D μm in whole developer particles is less than or equal to 4%.

2. The developer according to claim 1, wherein the number proportion of the developer particles having particle diameters in a range from 4 μm to 1.2×D μm is greater than or equal to 2%, and is less than or equal to 4%.

3. The developer according to claim 1, wherein the average particle diameter D of the brilliant pigments is 5 μm, and the number proportion of the developer particles having particle diameters in a range from 4 μm to 6 μm is less than or equal to 4%.

4. The developer according to claim 3, wherein the number proportion of the developer particles having particle diameters in a range from 4 μm to 6 μm is greater than or equal to 2%, and is less than or equal to 4%.

5. The developer according to claim 1, wherein the developer particles are formed by a dissolution suspension method.

6. The developer according to claim 5, wherein the developer particles are formed by mixing and granulating an oil phase in which the binder resin, the brilliant pigment, the yellow pigment, the magenta pigment, the reddish-orange fluorescent dye and the yellow fluorescent dye are dissolved or dispersed in an organic solvent, and a water phase in which a dispersant is dispersed in an aqueous medium.

7. A developer storage body that stores the developer according to claim 1.

8. A process unit comprising:

an image bearing body;

a charging member that charges a surface of the image bearing body;

a developer bearing body that develops a latent image on the image bearing body with a developer;

a supply member that supplies the developer to the developer bearing body;

a developer regulating member that regulates a thickness of a layer of the developer on the developer bearing body;

a cleaning member that removes a residual developer that remains on the surface of the image bearing body; and the developer storage body according to claim 7, the developer storage body supplying the developer to the supply member and the developer bearing body.

9. An image forming apparatus comprising:

the process unit according to claim 8; and an exposure device that forms a latent image on the image bearing body.

* * * * *